US010717575B2

(12) United States Patent
Schiering et al.

(10) Patent No.: US 10,717,575 B2
(45) Date of Patent: Jul. 21, 2020

(54) BOTTLE HOUSING

(71) Applicant: PROFESSIONAL DISPOSABLES INTERNATIONAL, INC., Orangeburg, NY (US)

(72) Inventors: Matthew Robert Schiering, New City, NY (US); Howard I. Moed, Glenside, PA (US); Thomas A. Klos, Glenside, PA (US)

(73) Assignee: PROFESSIONAL DISPOSABLES INTERNATIONAL. INC., Orangeburg, NY (US)

( * ) Notice: Subject to any disclaimer, the term of this patent is extended or adjusted under 35 U.S.C. 154(b) by 129 days.

(21) Appl. No.: 15/900,506

(22) Filed: Feb. 20, 2018

(65) Prior Publication Data

US 2018/0237196 A1 Aug. 23, 2018

Related U.S. Application Data

(60) Provisional application No. 62/461,645, filed on Feb. 21, 2017.

(51) Int. Cl.

| | |
|---|---|
| ***B65D 69/00*** | (2006.01) |
| ***A47L 13/51*** | (2006.01) |
| ***A47G 23/02*** | (2006.01) |
| ***A47K 10/42*** | (2006.01) |

(52) U.S. Cl.

CPC ..... *B65D 69/00* (2013.01); *A47K 10/42* (2013.01); *A47L 13/51* (2013.01); *A47G 23/02* (2013.01)

(58) Field of Classification Search

CPC ..... B56D 69/00; A47L 13/51; A47G 23/0241; A47G 23/0216

See application file for complete search history.

(56) References Cited

U.S. PATENT DOCUMENTS

| | | | | |
|---|---|---|---|---|
| 2,303,282 | A * | 11/1942 | Kirby | A47G 23/0241 215/13.1 |
| 2,593,384 | A * | 4/1952 | Butler | A47G 23/0216 312/319.1 |
| 6,082,595 | A | 7/2000 | Lin | |
| 6,321,937 | B1 | 11/2001 | Desimone et al. | |
| 6,431,405 | B2 | 8/2002 | Irwin | |
| 6,506,092 | B1 * | 1/2003 | Kuracina | A47G 23/0216 215/396 |
| 7,222,747 | B1 | 5/2007 | Savran | |
| 7,585,125 | B2 | 9/2009 | Mühlhausen et al. | |

(Continued)

*Primary Examiner* — Andrew T Kirsch

(74) *Attorney, Agent, or Firm* — Baker Botts L.L.P.

(57) ABSTRACT

A bottle housing, bottle housing structure and system for use is disclosed. The bottle housing includes a first member having a top, a first end, and a second end. The bottle housing also includes a second member having a top, a first end, and a second end. The second member is coupled to the first member along respective first ends. The first member and the second member are transitionable between an open position and a closed position. The first member and the second member define a housing cavity when in the closed position. The first member and the second member are configured to house a bottle body in the housing cavity. Respective tops of the first member and the second member are configured to surround a portion of a bottle neck when in the closed position. The bottle housing is configured to receive at least one component therein.

20 Claims, 12 Drawing Sheets

(56) References Cited

U.S. PATENT DOCUMENTS

| | | | | |
|---|---|---|---|---|
| 7,685,908 | B1 * | 3/2010 | Sebastian | A47G 23/0216 81/3.09 |
| 7,743,947 | B2 | 6/2010 | Flasch | |
| 8,708,591 | B2 | 4/2014 | Shepard, Jr. | |
| 9,010,582 | B1 | 4/2015 | Atkinson et al. | |
| 9,365,320 | B1 | 6/2016 | Erickson | |
| 2010/0301136 | A1 | 12/2010 | Scott | |
| 2016/0095423 | A1 | 4/2016 | Cotter | |
| 2016/0158776 | A1 | 6/2016 | Sternberg et al. | |
| 2016/0249758 | A1 | 9/2016 | Neiley et al. | |

* cited by examiner

BOTTLE HOUSING

CROSS-REFERENCE TO RELATED APPLICATIONS

This application claims priority to U.S. Provisional Application No. 62/461,645 filed on Feb. 21, 2017, the contents of which is hereby incorporated by reference in its entirety.

FIELD OF THE DISCLOSED SUBJECT MATTER

The disclosed subject matter relates to a housing to house a bottle, and particularly a bottle housing configured to receive at least one component therein.

BACKGROUND OF THE DISCLOSED SUBJECT MATTER

A bottle can be conveniently used with an accessory, such as with a paper towel for cleaning or with a bottle opener to open a bottle. Often the bottle can be used with an accessory by carrying the bottle and the accessory separately or with an accessory housing unit coupled to a customized bottle. In certain circumstances, a person may want to use a spray bottle in conjunction with a towel or wipe to dampen and dry a surface without constantly needing to find a clean towel or wipe. A variety of systems using accessory attachments can be used in conjunction with bottles, however, the systems generally require a customized bottle, which may be undesirable in situations where the same accessory is required for more than one task requiring the use of more than one bottle.

There thus remains a continued need for an efficient and economic system for attaching a component to more than one bottle. The presently disclosed subject matter satisfies these and other needs.

SUMMARY

The purpose and advantages of the disclosed subject matter will be set forth in and apparent from the description that follows, as well as will be learned by practice of the disclosed subject matter. Additional advantages of the disclosed subject matter will be realized and attained by the methods and systems particularly pointed out in the written description and claims hereof, as well as from the appended drawings.

To achieve these and other advantages and in accordance with the purpose of the disclosed subject matter, as embodied and broadly described, the disclosed subject matter includes a bottle housing including a first member having a top, a first end, and a second end, and a second member having a top, a first end, and a second end. The second member is coupled to the first member along respective first ends. The first member and the second member are transitionable between an open position and a closed position. The first member and the second member define a housing cavity when in the closed position. The first member and the second member are configured to house a bottle body in the housing cavity. Respective tops of the first member and the second member are configured to surround a portion of a bottle neck when in the closed position. The bottle housing is configured to receive at least one component therein.

Additionally, and as embodied herein, the first member and the second member can be pivotably coupled together along the respective first ends. The first member and the second member can be pivotably coupled by a hinge along the respective first ends. Additionally, at least a portion of the top of the first member can be disposed above a portion of the bottle body when in the closed position. At least a portion of the first member can be disposed below a portion of the bottle body when in the closed position.

As embodied herein, the first member can have a locking element disposed along the second end of the first member, the second member can have a receiving element disposed along the second end of the second member, wherein the locking element cooperates with the receiving element to lock and unlock the first member with the second member between the open position and the closed position. Furthermore, the locking element can comprise at least one flange, wherein the at least one flange is disposed along a ledge of the receiving element holding the first member and the second member in the closed position.

In addition, and as embodied herein, the first member can have at least a portion of a base configured to receive the at least one component. The base can have a top surface configured to support the bottle body when in the closed position. The first member, the second member, and the base can comprise a monolithic structure. Furthermore, the base can be configured to receive a removable compartment configured to receive the at least one component. The removable compartment can be configured to be at least one of slidably inserted into the base and coupled to a sidewall of the base. In addition, the base can include a base edge stop configured to restrict movement of the removable compartment in at least one direction. Furthermore, the removable compartment is coupled to the base by a biasing finger. The removable compartment can comprise a hook attachment that can be configured to receive the at least one component. The removable compartment can comprise a holder attachment that can be configured to receive the at least one component. The removable compartment can include a bottle opener attachment. In addition, the at least one component can comprise at least one of a nonwoven fabric, a container, and a woven fabric.

In accordance with another aspect of the disclosed subject matter, a bottle housing system is provided, including a bottle having a bottle body and a bottle neck, and a bottle housing having a first member and a second member. The first member has a top, a first end, and a second end. The second member has a top, a first end, and a second end. The second member is coupled to the first member along respective first ends. The first member and the second member are transitionable between an open position and a closed position. The first member and the second member define a housing cavity when in the closed position. The first member and the second member are configured to house the bottle body in the housing cavity. Respective tops of the first member and the second member are configured to surround a portion of the bottle neck when in the closed position. The bottle housing is configured to receive at least one component therein.

In accordance with another aspect of the disclosed subject matter, a method of using a bottle housing is provided. The method includes providing a bottle having a bottle body and a bottle neck and providing a bottle housing having a first member and a second member. The first member has a top, a first end, and a second end. The second member has a top, a first end, and a second end. The second member is coupled to the first member along respective first ends. The first member and the second member are transitionable between an open position and a closed position. The first member and the second member define a housing cavity when in the closed position. The first member and the second member are configured to house the bottle body in the housing cavity. Respective tops of the first member and the second member are configured to surround a portion of the bottle neck when in the closed position. The bottle housing is configured to receive at least one component therein. Furthermore, the method includes inserting the bottle body into the housing cavity and coupling the first member and the second member together in the closed position to house the bottle body.

It is to be understood that both the foregoing general description and the following detailed description are exemplary and are intended to provide further explanation of the disclosed subject matter claimed.

The accompanying drawings, which are incorporated in and constitute part of this specification, are included to illustrate and provide a further understanding of the structure, system, and method of the disclosed subject matter. Together with the description, the drawings serve to explain the principles of the disclosed subject matter.

DETAILED DESCRIPTION

Figure 1:
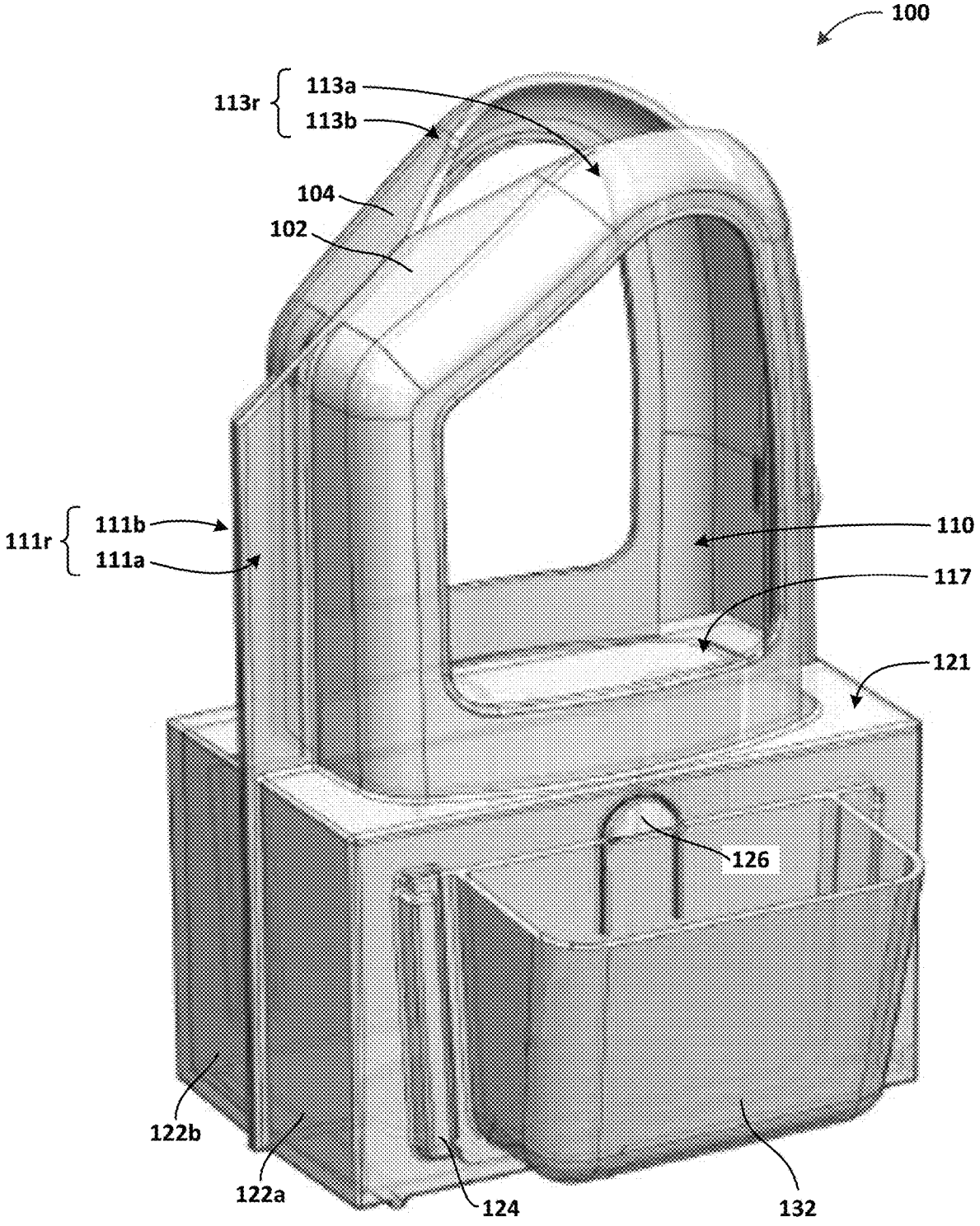
FIG. 1 is a first end perspective view of a bottle housing in a closed position, according to embodiments of the disclosed subject matter.

Reference will now be made in detail to various exemplary embodiments of the disclosed subject matter, exemplary embodiments of which are illustrated in the accompanying drawings. The structure, system, and corresponding method of used of the disclosed subject matter will be described in conjunction with the detailed description of the system.

In accordance with the disclosed subject matter, as embodied and broadly described, the disclosed subject matter includes a bottle housing including a first member having a top, a first end, and a second end, and a second member having a top, a first end, and a second end. The second member is coupled to the first member along respective first ends. The first member and the second member are transitionable between an open position and a closed position. The first member and the second member define a housing cavity when in the closed position. The first member and the second member are configured to house a bottle body in the housing cavity. Respective tops of the first member and the second member are configured to surround a portion of a bottle neck when in the closed position. The bottle housing is configured to receive at least one component therein.

The accompanying figures, where like reference numerals refer to identical or functionally similar elements throughout the separate views, serve to further illustrate various embodiments and to explain various principles and advantages all in accordance with aspects of the disclosed subject matter. For purpose of explanation and illustration, and not limitation, exemplary embodiments of the bottle housing and bottle housing system are shown in FIGS. 1-8, in accordance with aspects of the disclosed subject matter. While the presently disclosed subject matter is described regarding certain embodiments, one skilled in the art will recognize that components and the method of using the same are not limited to the illustrative embodiments described or depicted herein.

Figure 3C:
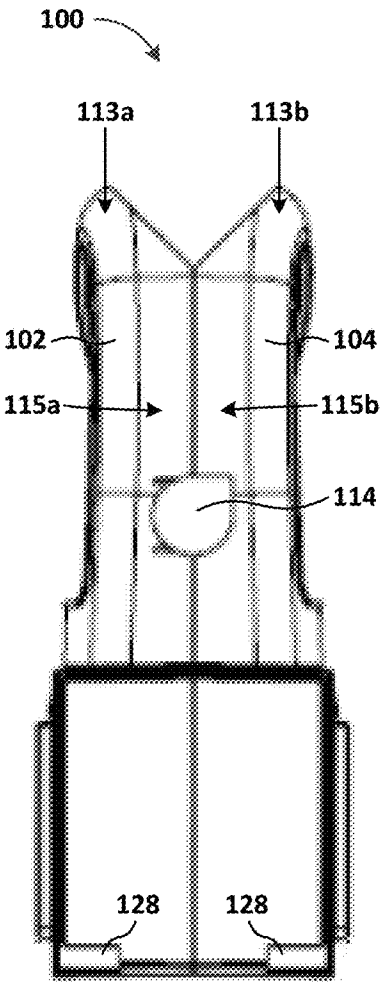
FIG. 3C is a second side view of the bottle housing of FIG. 1 in the closed position, according to embodiments of the disclosed subject matter.
Figure 3B:
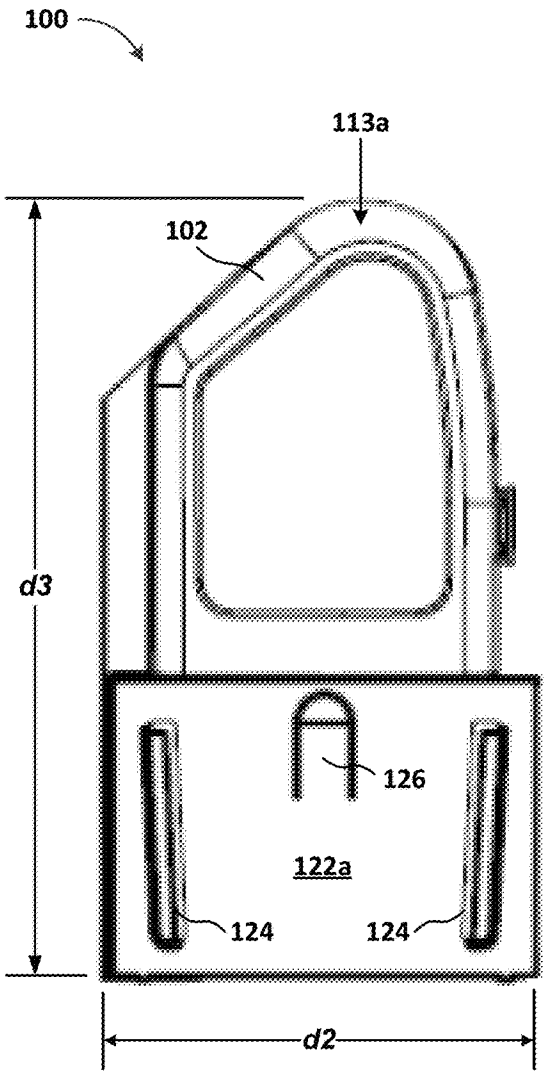
FIG. 3B is a front view of the bottle housing of FIG. 1 in the closed position, according to embodiments of the disclosed subject matter.
Figure 3A:
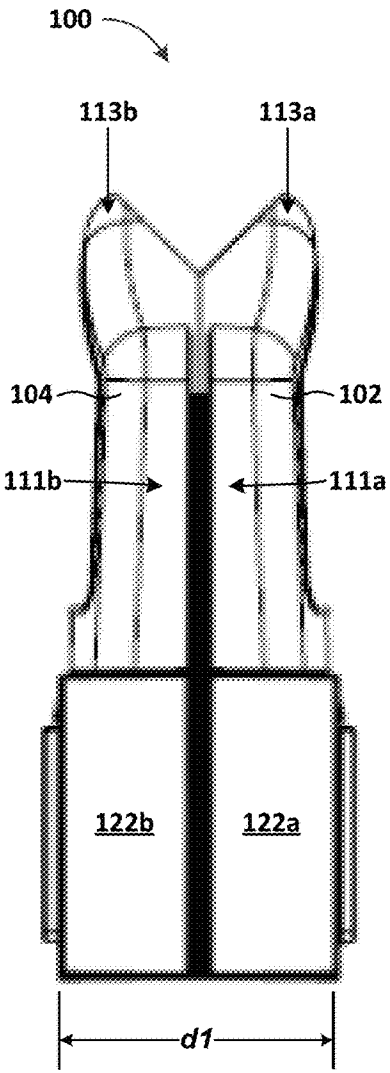
FIG. 3A is a first side view of the bottle housing of FIG. 1 in the closed position, according to embodiments of the disclosed subject matter.
Figure 3D:
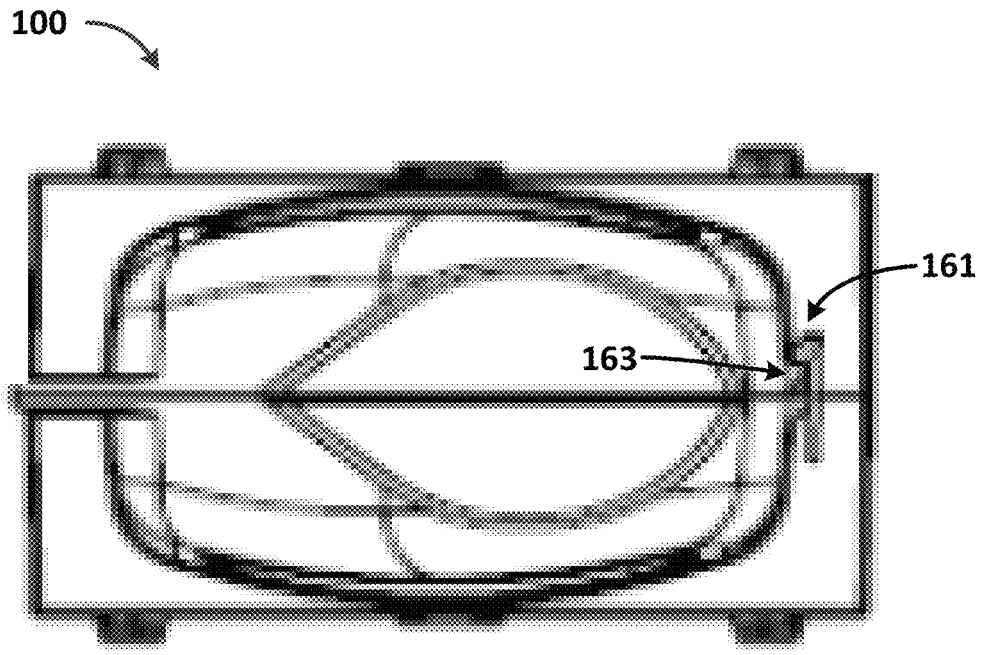
FIG. 3D is a top view of the bottle housing of FIG. 1 in the closed position, according to embodiments of the disclosed subject matter.
Figure 3E:
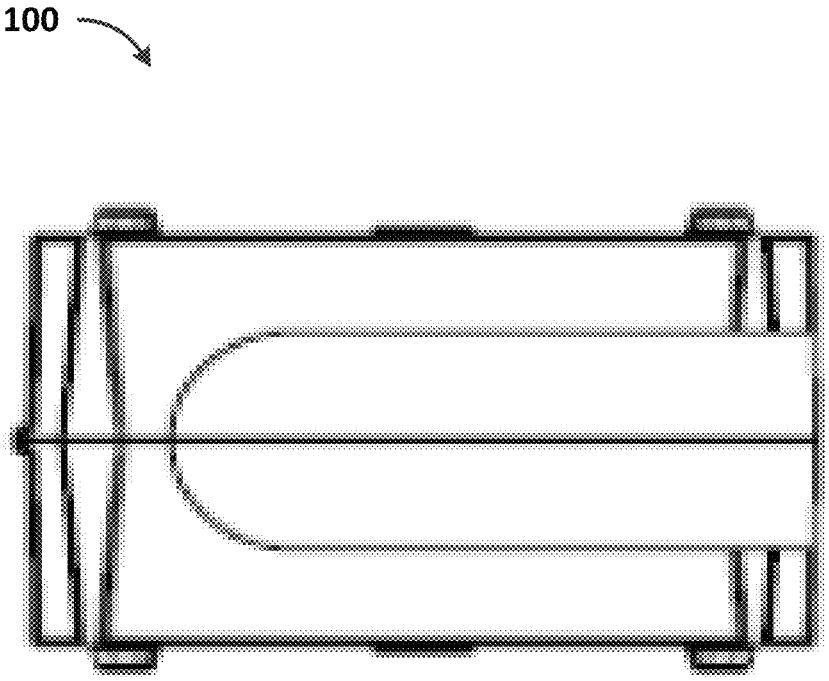
FIG. 3E is a bottom view of the bottle housing of FIG. 1 in the closed position, according to embodiments of the disclosed subject matter.
Figure 4C:
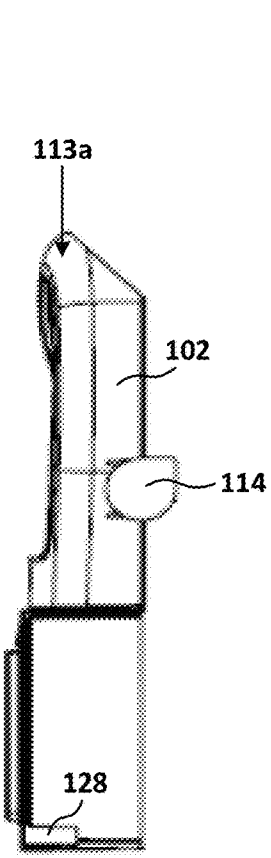
FIG. 4C is a second side view of the bottle housing of FIG. 1 in the a open position, according to embodiments of the disclosed subject matter.
Figure 4B:
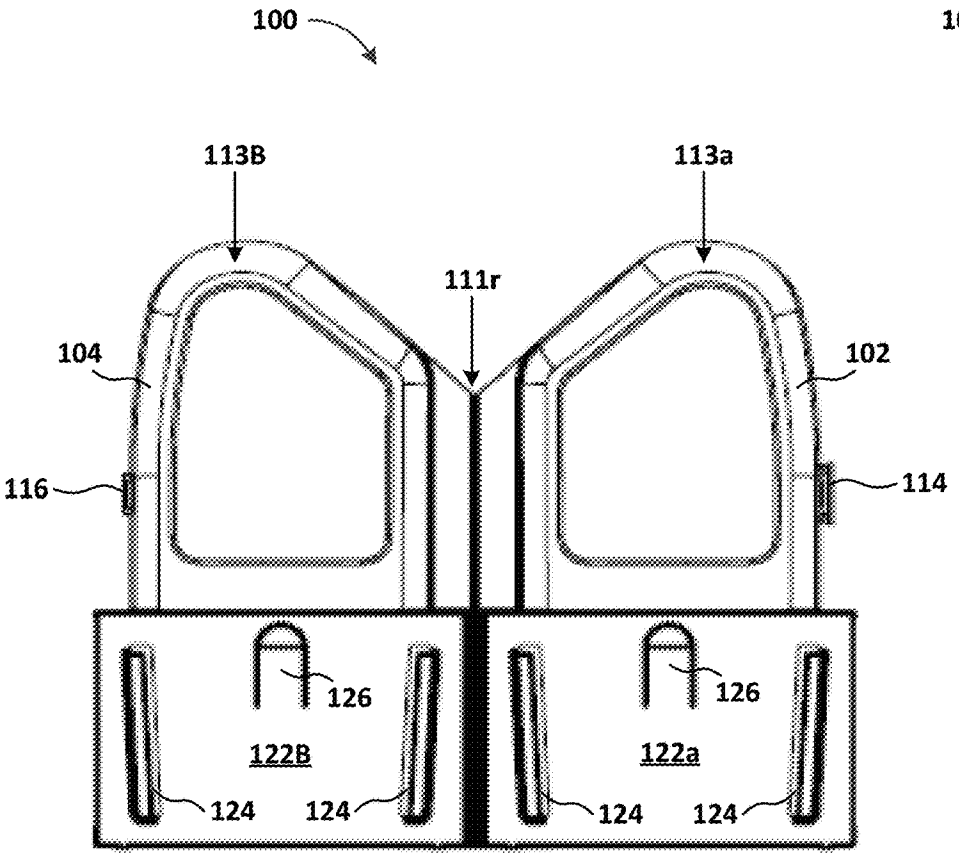
FIG. 4B is a front and back external view of the bottle housing of FIG. 1 in the open position, according to embodiments of the disclosed subject matter.
Figure 4A:
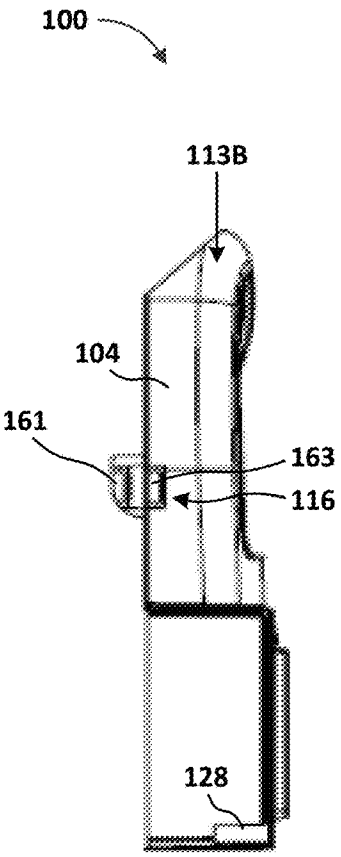
FIG. 4A is a first side view of the bottle housing of FIG. 1 in an open position, according to embodiments of the disclosed subject matter.
Figure 4D:
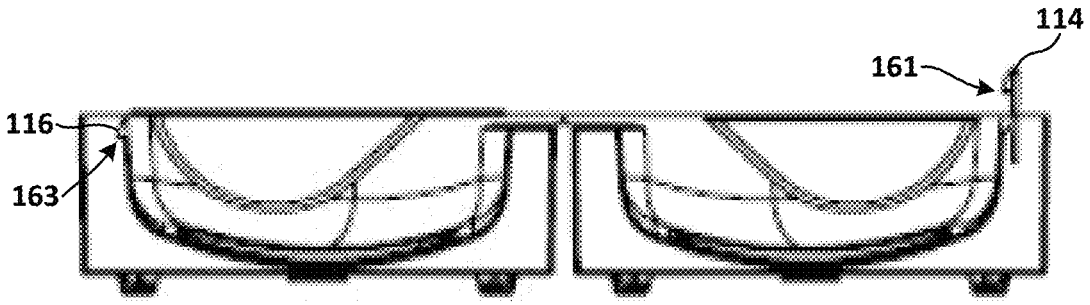
FIG. 4D is a top view of the bottle housing of FIG. 1 in the open position, according to embodiments of the disclosed subject matter.
Figure 4E:
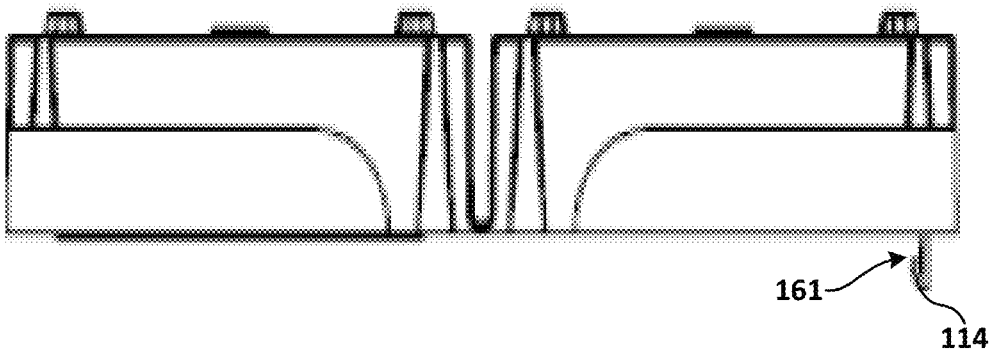
FIG. 4E is a bottom view of the bottle housing of FIG. 1 in the open position, according to embodiments of the disclosed subject matter.
Figure 4G:
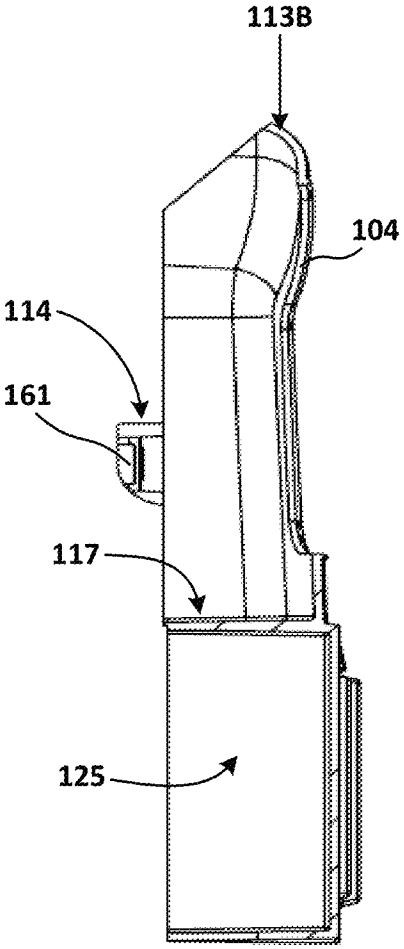
FIG. 4G is a cross-sectional side view of the bottle housing of FIG. 1 in the open position, according to embodiments of the disclosed subject matter.
Figure 4F:
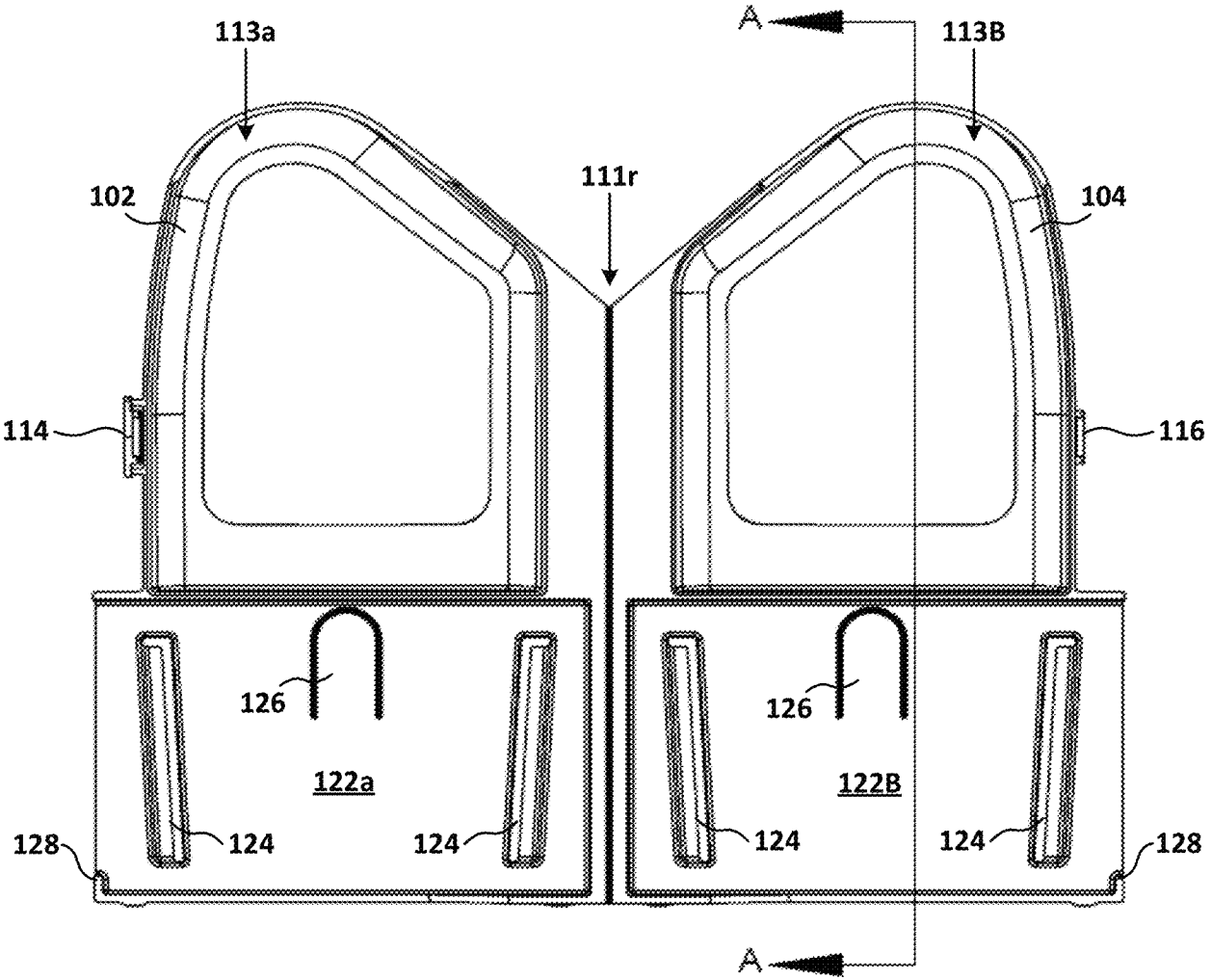
FIG. 4F is a front and back internal view of the bottle housing of FIG. 1 in the open position, according to embodiments of the disclosed subject matter.
Figure 6:
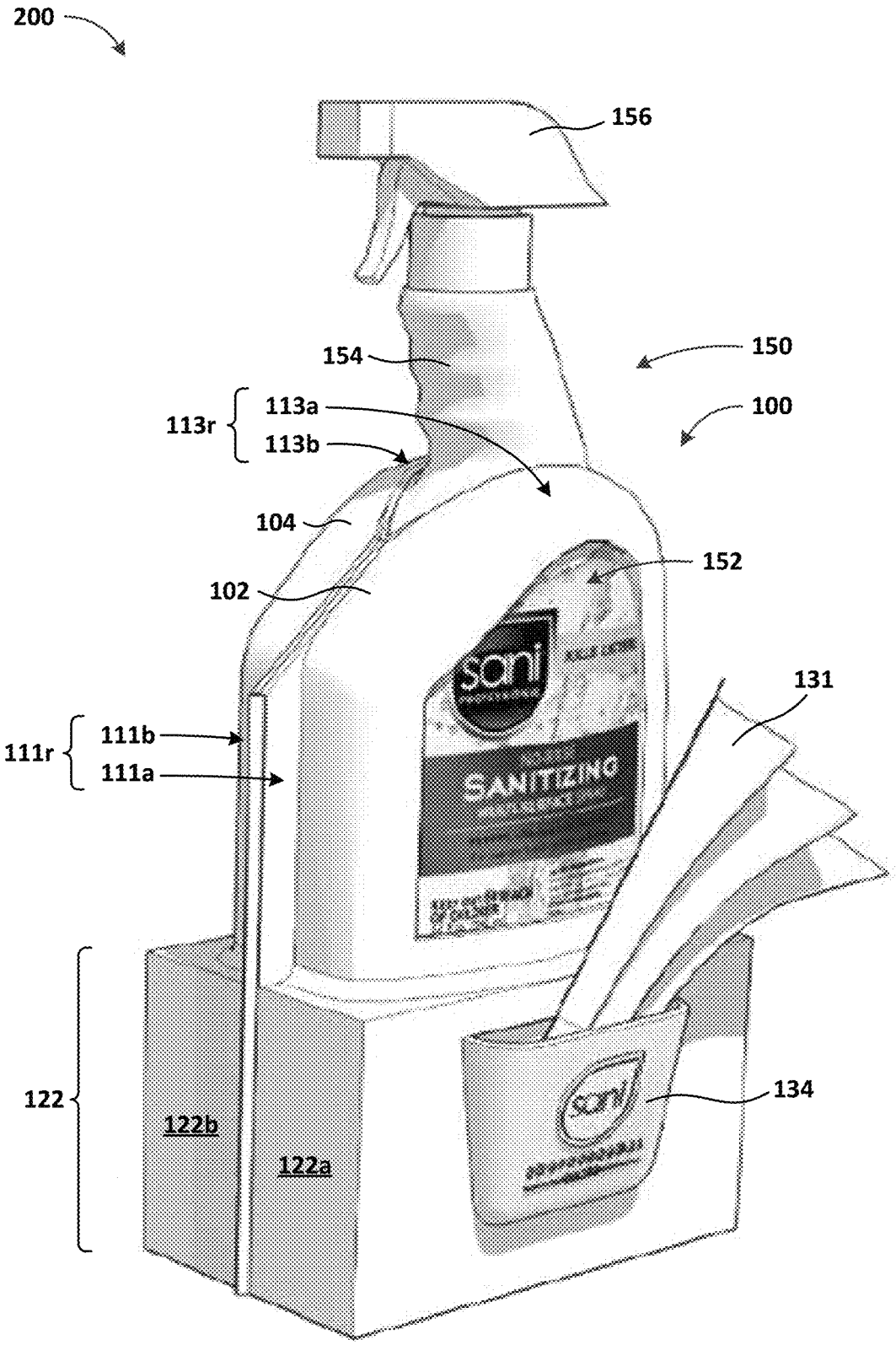
FIG. 6 is a first end perspective view of a bottle housing system depicting a bottle compartment and bottle housing in a closed position, according to embodiments of the disclosed subject matter.
Figure 7A:
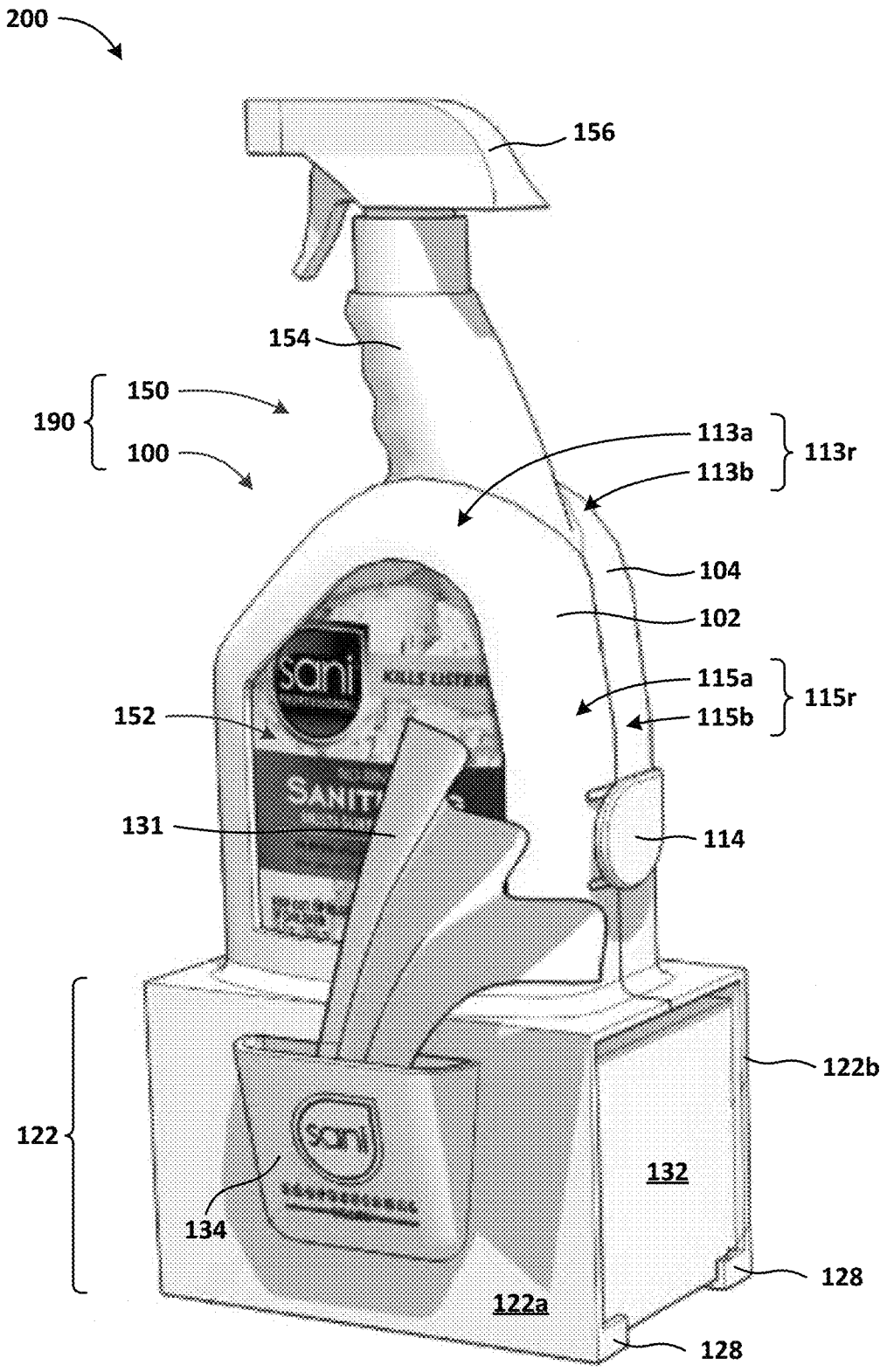
FIG. 7A is a second end perspective view of the bottle housing system of FIG. 6 in the closed position, according to embodiments of the disclosed subject matter.

Solely for purpose of illustration, with reference to FIGS. 1-4G, a bottle housing 100 is provided, according to aspects of the disclosed subject matter. FIGS. 1-3E illustrate the bottle housing 100 in a closed position and FIGS. 4A-4G illustrate the bottle housing 100 in an open position, wherein FIG. 4G is a cross-sectional view of the bottle housing 100 shown in FIG. 4F taken along cross-sectional line A-A, according to aspects of the disclosed subject matter. For example, and as embodied herein, the bottle housing 100 includes a first member 102 having a top 113*a*, a first end 111*a*, and a second end 115*a*. The bottle housing also includes a second member 104 having a top 113*b*, a first end 111*b*, and a second end 115*b*. The second member 104 is coupled to the first member 102 along respective first ends 111*r*. The first member 102 and the second member 104 are transitionable between an open position and a closed position. The first member 102 and the second member 104 define a housing cavity 110 when in the closed position. The first member 102 and the second member 104 are configured to house a bottle body in the housing cavity 110, such as a bottle body of a conventional bottle as further discussed herein. Respective tops 113*r* of the first member 102 and the second member 104 are configured to surround a portion of a bottle neck when in the closed position. The bottle housing 100 is configured to receive at least one component 131 therein, as shown in FIGS. 6 and 7A further described herein.

As noted above, a bottle having the bottle body and the bottle neck can be features of a conventional bottle. For example, the bottle can comprise a spray bottle where the bottle neck is a handle and a bottle head includes an actuation lever for delivering a liquid contained within the bottle body. An exemplary bottle is provided with reference to FIGS. 6 and 7A, according to aspects of the disclosed subject matter. However, other conventional bottles that can utilize the bottle housing are contemplated herein. Furthermore, at least a portion of the top 113*a* of the first member 102 can be disposed above a portion of the bottle body when in the closed position. In the illustrated embodiment, the top 113*a* and the top 113*b* of the first member 102 and the second member 104, respectively, each include a portion disposed above the bottle body when in the closed position.

The first member 102 and the second member 104 can be coupled together along the respective first ends 111*r*. For example, the first member 102 and the second member 104 can pivot with respect to each other and be coupled by a hinge along the respective first ends 111*r*. As such, the hinge can be a pivot hinge, a living hinge, a monolithic hinge, a self-closing hinge, or any other suitable hinge. Alternatively, the first member 102 and the second member 104 can be entirely separable and coupled together at the respective first ends 111*r* in any suitable manner, such as with a barrel hinge or a lift-off hinge.

The bottle housing can additionally include a lock including a locking element 114 and a receiving element 116, the lock disposed at least at the respective first ends 111*r* or respective second ends 115*r*. As shown in the figures, the first member 102 can have the locking element 114 disposed along the second end 115*a* of the first member 102 and the receiving element 116 disposed along the second end 115*b* of the second member 104. As such, the locking element 114 cooperates with the receiving element 116 to lock and unlock the first member 102 with the second member 104 between the open position and the closed position. For example, as best shown in FIGS. 3D and 4A, the locking element 114 can comprise at least one flange 161, wherein the at least one flange 161 is disposed along a ledge 163 of the receiving element 116. The locking element 114 and the receiving element 116 hold the first member 102 and the second member 104 in the closed position. However, any locking or coupling mechanism may be used to hold the first member 102 and the second member 104 in the closed position, such as, but not limited to, a cam lock, a draw latch, a swing latch, or a slide bolt. The lock used can include logos or advertisements, such as a tear drop catch, an embossed logo, or a sticker.

Figure 2:
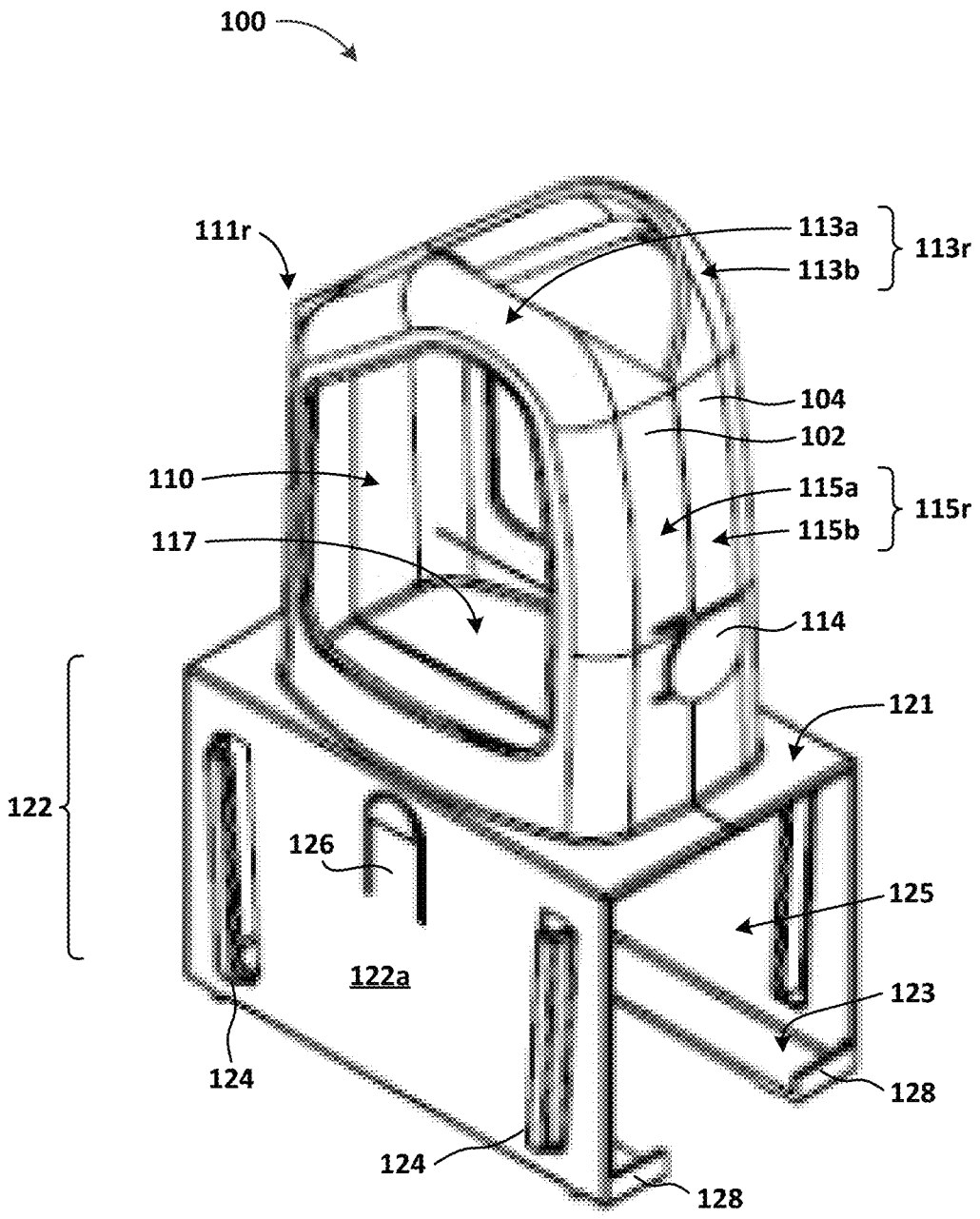
FIG. 2 is a second end perspective view of the bottle housing of FIG. 1 in the closed position, according to embodiments of the disclosed subject matter.

Additionally, and as best shown in FIG. 2, the first member 102 can include at least a portion of a base 122 configured to receive the at least one component. The base 122 can be coupled to the bottom of the first member 102, as illustrated, but is not limited thereto. In the illustrated embodiment, the first member 102 includes a first portion 122*a* of the base 122 and the second member 104 includes a second portion 122*b* of the base 122 each monolithic with, or coupled to, a bottom portion of the respective members. The bottle housing 100 can include a support surface 117, as best shown in FIG. 4G, configured to support the bottle body when in the closed position. The support surface 117 can be a portion of the first member 102, the second member 104, and/or the base 122. For example, the base 122 can have a top surface 121 configured to support the bottle body when in the closed position, whereby the top surface 121 comprises the support surface 117. The first member 102, the second member 104, and/or the base 122 can comprise a monolithic structure.

Additionally, and as embodiment herein, the base 122 can be configured to receive a removable compartment 132 as shown in FIGS. 5A-5G, 7A and 7B. For example, the removable compartment 132, shown in FIG. 7B, can be configured to be slidably inserted into the base 122 as depicted in FIG. 7A. In such embodiment, the removable compartment 132 can comprise a container box of nonwoven fabrics, such as, but not limited to, a wet or dry wipe. For example, the base 122 can have an opening 125 configured to receive the removable compartment 132, as best shown in FIGS. 2 and 7A. The base 122 can include a base edge stop 128 configured to restrict movement of the removable compartment 132 in at least one direction. For example, the removable compartment 132 can be inserted into the opening 125 from above the base edge stop 128. Alternatively, the compartment can be inserted into the opposite side from opening 125, in such an alternative embodiment. However, as best shown in FIG. 3A, the presently shown embodiment includes a closed end opposite the opening 125. The removable compartment 132 can rest on a bottom surface 123 when inserted, and the base edge stop 128 can be configured to secure the removable compartment 132 within the opening 125.

In addition, and as embodied herein, the removable compartment 132 can be coupled to the base along a sidewall thereof, such as by a biasing finger 126 and/or with guide edges 124 as best shown in FIG. 1. The biasing finger 126 can be in the form of a releasable button.

Figure 5C:
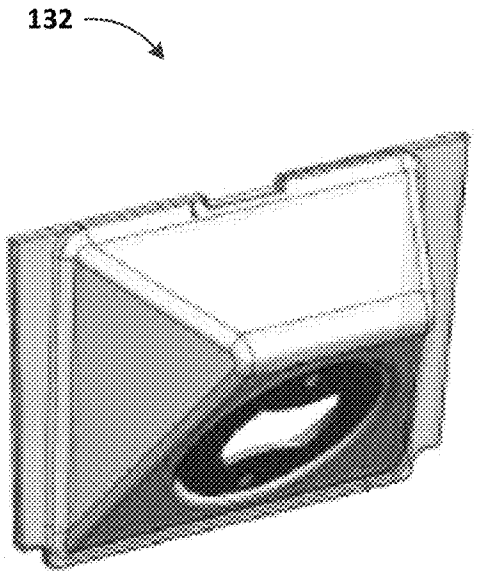
FIG. 5C is an perspective view of another removable compartment attachable to the bottle housing of FIG. 1, according to embodiments of the disclosed subject matter.
Figure 5B:
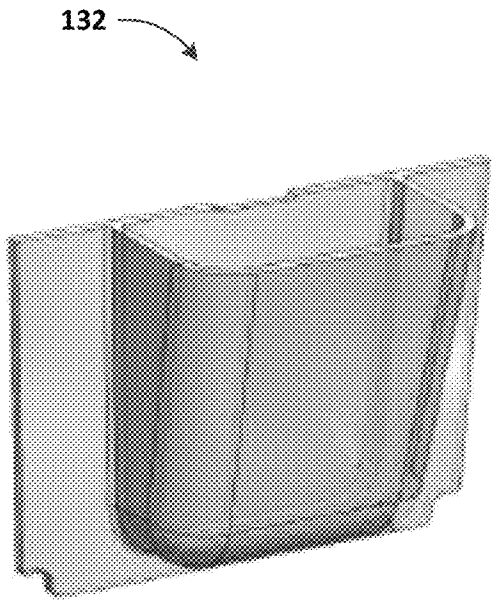
FIG. 5B is a perspective view of another removable compartment attachable to the bottle housing of FIG. 1, according to embodiments of the disclosed subject matter.
Figure 5A:
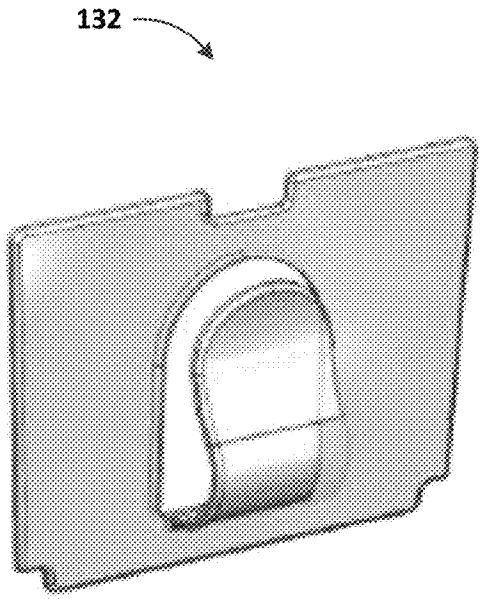
FIG. 5A is a perspective view of a removable compartment attachable to the bottle housing of FIG. 1, according to embodiments of the disclosed subject matter.

Referring now to FIGS. 5A-5C, alternative removable compartments 132 configured to be coupled to the base 122 are provided, according to aspects of the disclosed subject matter. For example, the removable compartment 132 can include a hook attachment, as shown in FIG. 5A, in which the at least one component can be attached thereto. Additionally or alternatively, the removable compartment 132 can be a holder attachment, as shown in FIG. 5B. Additionally or alternatively, the removable compartment 132 can include a bottle opener attachment, as shown in FIG. 5C. Other alternatives for the removable compartment 132 can include, but are not limited to, side bristles for scrubbing and/or a waste basket. Furthermore, the bottle housing 100 can include a fixed compartment 134, as shown in FIG. 6, that is monolithic with the base. As noted above, components receivable in and/or coupled to the removable compartment 132 can include any suitable accessory such as, but not limited to, a wet or dry wipe, a tire pump, a brush, and the any accessory that can fit within the compartment.

Furthermore, and as embodied herein, the bottle housing 100 can have a width dimension (d1), a depth dimension (d2) and a height dimension (d3). The width dimension (d1) range from about 3 inches to about 6 inches and may increase with, for example, the protrusion of the guide edges 124 and the biasing finger 126. The depth dimension (d2) range from about 5 inches to about 10 inches and may increase with, for example, the protrusion of the coupled respective first ends 111*r*. The height dimension (d3) can range from about 8 inches to about 12 inches and may increase with any protrusions extending from the respective tops 113*r* or the bottom of the base 122. The described dimensions are for exemplary purposes only and are not meant to be limitations.

In accordance with another aspect of the disclosed subject matter, and as embodied herein, a bottle housing system is provided, including a bottle having a bottle body and a bottle neck, and a bottle housing having a first member and a second member. The first member has a top, a first end, and a second end. The second member has a top, a first end, and a second end. The second member is coupled to the first member along respective first ends. The first member and the second member are transitionable between an open position and a closed position. The first member and the second member define a housing cavity when in the closed position. The first member and the second member are configured to house a bottle body in the housing cavity. Respective tops of the first member and the second member are configured to surround a portion of a bottle neck when in the closed position. The bottle housing is configured to receive at least one component therein.

Figure 7B:
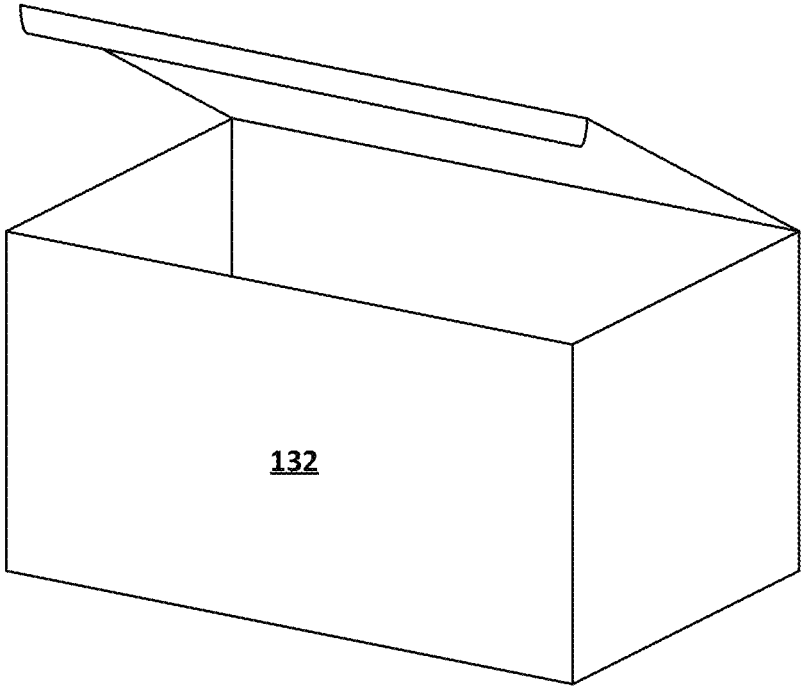
FIG. 7B is a perspective view of a removable compartment coupleable with the bottle housing of FIG. 1, according to embodiments of the disclosed subject matter.

Solely for purpose of illustration, with reference to FIGS. 6-7B, a bottle housing system 200 is provided, according to aspects of the disclosed subject matter. For example, and similar to the previously described embodiments, the bottle housing system 200 includes a bottle 150 having a bottle body 152 and a bottle neck 154, and a bottle housing 100 having a first member 102 and a second member 104. The first member 102 has a top 113*a*, a first end 111*a*, and a second end 115*a*. The second member 104 has a top 113*b*, a first end 111*b*, and a second end 115*b*. The second member 104 is coupled to the first member 102 along respective first ends 111*r*. The first member 102 and the second member 104 are transitionable between an open position and a closed position. The first member 102 and the second member 104 define a housing cavity when in the closed position. The first member 102 and the second member 104 are configured to house the bottle body 152 in the housing cavity. Respective tops 113*r* of the first member 102 and the second member 104 are configured to surround a portion of the bottle neck 154 when in the closed position. The bottle housing 100 is configured to receive at least one component 131 therein.

In view of the above, the bottle housing system 200 of the disclosed subject matter can incorporate the components and features of the bottle housing 100 described with respect to FIGS. 1-5C. For example, and as illustrated, the bottle housing 100 can include the removable compartment 132 configured to receive at least one component 131, and a fixed compartment 134 configured to receive the at least one component 131. The components 131 can include, but are not limited to, a nonwoven fabric, a container, and a woven fabric.

In accordance with another aspect of the disclosed subject matter, and as embodied herein, a method of using a bottle housing is provided. The method includes providing a bottle having a bottle body and a bottle neck and providing a bottle housing having a first member and a second member. The first member has a top, a first end, and a second end. The second member has a top, a first end, and a second end. The second member is coupled to the first member along respective first ends. The first member and the second member are transitionable between an open position and a closed position. The first member and the second member define a housing cavity when in the closed position. The first member and the second member are configured to house the bottle body in the housing cavity. Respective tops of the first member and the second member are configured to surround a portion of the bottle neck when in the closed position. The bottle housing is configured to receive at least one component therein. Furthermore, the method includes inserting the bottle body into the housing cavity and coupling the first member and the second member together in the closed position to house the bottle body.

Figure 8:
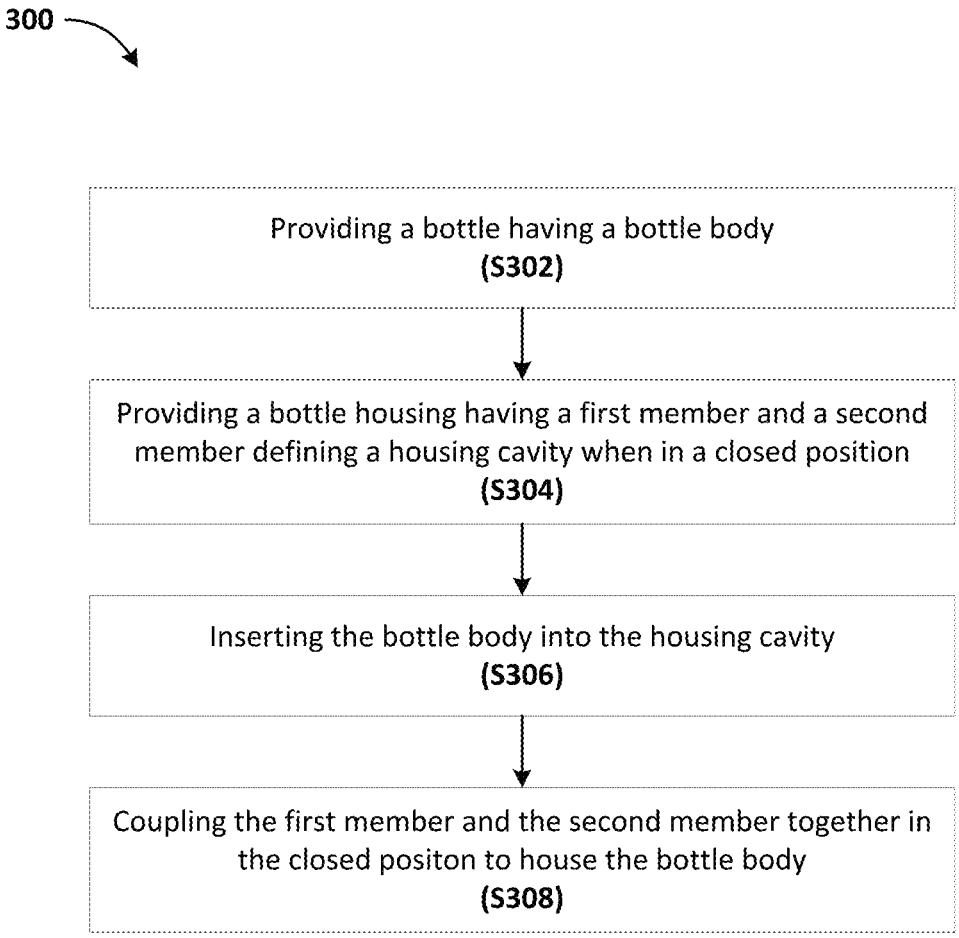
FIG. 8 is an operational flowchart depicting steps to use a bottle housing, according to embodiments of the disclosed subject matter.

Solely for purpose of illustration, with reference to FIG. 8, an operational flowchart illustrating a method of using a bottle housing is provided, according to aspects of the disclosed subject matter. The method of using the bottle housing can incorporate the components and features of the bottle housing 100 described with respect to FIGS. 1-5C and the bottle housing system 200 described with respect to FIGS. 6-7B. For example, and as embodied herein, the method of using the bottle housing 100 includes providing a bottle 150 having a bottle body 152 and a bottle neck 154 (S302) and providing a bottle housing 100 having a first member 102 and a second member 104 (S304). The first member 102 has a top 113*a*, a first end 111*a*, and a second end 115*a*. The second member 104 has a top 113*b*, a first end 111*b*, and a second end 115*b*. The second member 104 is coupled to the first member 102 along respective first ends 111*r*. The first member 102 and the second member 104 are transitionable between an open position and a closed position. The first member 102 and the second member 104 define a housing cavity 110 when in the closed position. The first member 102 and the second member 104 are configured to house the bottle body 152 in the housing cavity 110. Respective tops 113*r* of the first member 102 and the second member 104 are configured to surround a portion of the bottle neck 154 when in the closed position. The bottle housing 100 is configured to receive at least one component 131 therein. Furthermore, the method includes inserting the bottle body 152 into the housing cavity 110 (S306) and coupling the first member 102 and the second member 104 together in the closed position to house the bottle body 152 (S308).

According to aspects of the disclosed subject matter, the bottle housing 100 can be any suitable material capable of forming the described structure, such as, but not limited to, polypropylene, polyethylene, polyvinyl chloride or acrylonitrile butadiene styrene. The bottle housing 100 can be formed using any suitable formation technique such as blow molding, injection molding, or vacuum molding.

In addition to the specific embodiments claimed below, the disclosed subject matter is also directed to other embodiments having any other possible combination of the dependent features claimed below and those disclosed above. As such, the particular features presented in the dependent claims and disclosed above can be combined with each other in other manners within the scope of the disclosed subject matter such that the disclosed subject matter should be recognized as also specifically directed to other embodiments having any other possible combinations. Thus, the foregoing description of specific embodiments of the disclosed subject matter has been presented for purposes of illustration and description. It is not intended to be exhaustive or to limit the disclosed subject matter to those embodiments disclosed.

It will be apparent to those skilled in the art that various modifications and variations can be made in the method and system of the disclosed subject matter without departing from the spirit or scope of the disclosed subject matter. Thus, it is intended that the disclosed subject matter include modifications and variations that are within the scope of the appended claims and their equivalents.

What is claimed is:

1. A bottle housing comprising:

a first member having a top, a first end, and a second end, wherein the first member defines an opening; and a second member having a top, a first end, and a second end, wherein the second member defines an opening, wherein the second member is coupled to the first member along respective first ends, the first member and the second member are transitionable between an open position and a closed position, the first member and the second member defining a housing cavity when in the closed position, the first member and the second member configured to house a bottle body in the housing cavity, wherein the housing cavity is accessible through the openings of the first and second members, wherein respective tops of the first member and the second member define a top opening when in the closed position to receive a portion of a bottle neck and are configured to surround the portion of the bottle neck when in the closed position, and wherein the bottle housing is configured to receive at least one component therein.

2. The bottle housing of claim 1, wherein the first member and the second member are coupled by a hinge along the respective first ends.

3. The bottle housing of claim 2, wherein the hinge comprises at least one of a living hinge and a monolithic hinge.

4. The bottle housing of claim 1, wherein at least a portion of the top of the first member is disposed above a portion of the bottle body when in the closed position.

5. The bottle housing of claim 1, wherein at least a portion of the first member is disposed below a portion of the bottle body when in the closed position.

6. The bottle housing of claim 1, wherein the first member has a locking element disposed along the second end of the first member, the second member has a receiving element disposed along the second end of the second member, wherein the locking element cooperates with the receiving element to lock and unlock the first member with the second member between the open position and the closed position.

7. The bottle housing of claim 6, wherein the locking element comprises at least one flange, wherein the at least one flange is disposed along a ledge of the receiving element holding the first member and the second member in the closed position.

8. The bottle housing of claim 1, wherein the first member includes at least a portion of a base configured to receive the at least one component.

9. The bottle housing of claim 8, wherein the base has a top surface configured to support the bottle body when in the closed position.

10. The bottle housing of claim 8, wherein the first member, the second member and the base comprise a monolithic structure.

11. The bottle housing of claim 8, wherein the base is configured to receive a removable compartment, the removable compartment is configured to receive the at least one component.

12. The bottle housing of claim 11, wherein the removable compartment is configured to be at least one of slidably inserted into the base and coupled to a sidewall of the base.

13. The bottle housing of claim 12, wherein the base includes a base edge stop configured to restrict movement of the removable compartment in at least one direction.

14. The bottle housing of claim 11, wherein the removable compartment is coupled to the base using a biasing finger.

15. The bottle housing of claim 14, wherein the removable compartment comprises a hook attachment that is configured to receive the at least one component.

16. The bottle housing of claim 14, wherein the removable compartment comprises a holder attachment that is configured to receive the at least one components.

17. The bottle housing of claim 14, wherein the removable compartment includes a bottle opener attachment.

18. The bottle housing of claim 1, wherein the at least one component comprises at least one of a nonwoven fabric, a container, and a woven fabric.

19. A bottle housing system comprising:

a bottle having a bottle body and a bottle neck; and a bottle housing having a first member and a second member, the first member having a top, a first end, and a second end, wherein the first member defines an opening, the second member having a top, a first end, and a second end, wherein the second member defines an opening, wherein the second member is coupled to the first member along respective first ends, the first member and the second member are transitionable between an open position and a closed position, the first member and the second member defining a housing cavity when in the closed position, the first member and the second member configured to house the bottle body in the housing cavity, wherein the housing cavity is accessible through the openings of the first and second members, wherein respective tops of the first member and the second member define a top opening when in the closed position to receive a portion of the bottle neck and are configured to surround the portion of the bottle neck when in the closed position, and wherein the bottle housing is configured to receive at least one component therein.

20. A method of using a bottle housing comprising:

providing a bottle having a bottle body and a bottle neck;

providing a bottle housing having a first member and a second member, the first member having a top, a first end, and a second end, wherein the first member defines an opening, the second member having a top, a first end, and a second end, wherein the second member defines an opening, wherein the second member is coupled to the first member along respective first ends, the first member and the second member are transitionable between an open position and a closed position, the first member and the second member defining a housing cavity when in the closed position, the first member and the second member configured to house the bottle body in the housing cavity, wherein the housing cavity is accessible through the openings of the first and second members, wherein respective tops of the first member and the second member define a top opening when in the closed position to receive a portion of the bottle neck and are configured to surround the portion of the bottle neck when in the closed position, and wherein the bottle housing is configured to receive at least one component therein;

inserting the bottle body into the housing cavity; and coupling the first member and the second member together in the closed position to house the bottle body.

* * * * *